US005294116A

United States Patent [19]

Ahrens

[11] Patent Number: 5,294,116

[45] Date of Patent: Mar. 15, 1994

[54] STRING TENSIONING SYSTEM FOR BALL RACKET

[76] Inventor: Karl Ahrens, Altenauer Weg 8, D-3000 Hannover 21, Fed. Rep. of Germany

[21] Appl. No.: 931,357

[22] Filed: Aug. 18, 1992

Related U.S. Application Data

[63] Continuation of Ser. No. 427,184, Oct. 25, 1989, abandoned.

[30] Foreign Application Priority Data

Oct. 28, 1988 [DE] Fed. Rep. of Germany ..... 3836752

[51] Int. Cl.[5] ..... A63B 51/12

[52] U.S. Cl. ..... 273/73 R; 273/73 E

[58] Field of Search ..... 273/73 R, 73 A, 73 B, 273/73 C, 73 D, 73 E, 73 F, 73 G

[56] References Cited

U.S. PATENT DOCUMENTS

| | | | |
|---|---|---|---|
| 1,790,156 | 1/1931 | Kleinman | 273/73 E |
| 3,994,496 | 11/1976 | Barchett | 273/73 A |
| 4,168,065 | 9/1979 | Goransson | 273/73 D |
| 4,180,265 | 12/1979 | Staufer . | |
| 4,512,576 | 4/1985 | Dahlgren . | |
| 4,662,632 | 5/1987 | Bjorhn | 273/73 D |
| 4,721,304 | 1/1988 | Zavilenski | 273/73 E |
| 4,752,071 | 6/1988 | Tobach | 273/73 R |
| 4,863,163 | 9/1989 | Anderka et al. | 273/73 D |
| 5,149,090 | 9/1992 | Chen et al. | 273/73 D |

FOREIGN PATENT DOCUMENTS

| | | | |
|---|---|---|---|
| 2922631 | 12/1980 | Fed. Rep. of Germany | 273/73 D |
| 3143674 | 5/1983 | Fed. Rep. of Germany | 273/73 D |
| 3324142 | 1/1985 | Fed. Rep. of Germany | 273/73 D |
| 2080124 | 2/1982 | United Kingdom | 273/73 D |
| 2223953 | 4/1990 | United Kingdom | 273/73 D |
| 8403221 | 8/1984 | World Int. Prop. O. . | |

*Primary Examiner*—William Stoll
*Attorney, Agent, or Firm*—Meltzer, Lippe, Goldstein, Wolf, Schlissel & Sazer

[57] ABSTRACT

A string tensioning system is provided for ball rackets, in particular for tennis rackets and squash rackets. The string tensioning system, formed by a string tensioning member (1), is insertable between the substantially parallel disposed strings (2 to 7) of a ball racket (19) such that these substantially parallel disposed strings are lifted up and down, respectively, relative to their original common plane and relative to each neighboring string of a parallel direction. Thereby the strings are retensioned and the original stringing hardness is recovered.

1 Claim, 2 Drawing Sheets

STRING TENSIONING SYSTEM FOR BALL RACKET

This is a continuation of application Ser. No. 07/427,184, filed Oct. 25, 1989 now abandoned.

BACKGROUND OF THE INVENTION

1. Field of the Invention

The invention relates to a string tensioning part for stringed ball rackets, in particular for tennis rackets and squash rackets.

2. Brief Description of the Background of the Invention Including Prior Art

Frequently, there exists a desire in connection with tennis rackets to change the stringing hardness and, in fact, in particular to increase the stringing hardness.

This may be the case, for example, where the hardness of the balls is changed. In a tennis tournament, for example, the players always use new balls, which are substantially harder than the balls normally used. However, this leads to the situation where, in case of an identical expenditure of force, the balls fly farther and, as a result, pass the baseline more frequently. In view of the short time available, an adaptation of the mode of play to the changed situation, is in most cases no longer possible.

As is known, the hardness changes in the course of time in connection with older stringing of rackets. Depending on the material and original hardness, this occurs at different time lapses. The stringing hardness can thereby decrease to such an extent that, based on the resulting trampoline effect, a controlled game is no longer possible.

The hardness decreases in case of catgut stringing, if the strings have become humid. Even in case of an otherwise completely perfect and hardly worn stringing, an expensive restringing is required.

The hardness decreases particularly rapidly in case of a first stringing of a new frame. It can occur in such cases that, in case of an original hardness of 25 kg, after one week there remains a hardness of only 20 kg.

Finally, it is desirable, in case of different floor surfaces of the courts, that the stringing hardness be adapted in each case. A "fast" hall floor surface, for example, requires a harder stringing.

Special tennis rackets have already become known, where the tension of the center longitudinal strings can be changed by turning and rotating of a set screw at the handle end. Such rackets are, however, relatively expensive and have not found wide-spread acceptance.

There are further known plastic platelets, which are inserted between the crossing points of the longitudinal and cross strings. These platelets are to decrease the wear generated by the friction of the strings at the crossing points. The platelets effect, in case of a large-surface application, also a slight increase of the stringing hardness. However, the time-consuming insertion of a large number of such platelets in order to achieve a noticeable increase in the tensioning is a serious disadvantage.

SUMMARY OF THE INVENTION

1. Purposes of the Invention

It is an object of the present invention to provide a structure, which allows a racket player to quickly increase or, respectively, decrease the stringing hardness of his/her racket if desired.

It is another object of the present invention to provide a structure which is adaptable to a number of tennis rackets for increasing instantaneously the hardness of the stringing.

It is yet a further object of the present invention to provide a structure together with a tool for removing such structure from the stringing area of a tennis racket in connection with controlling the hardness of the stringing.

These and other objects and advantages of the present invention will become evident from the description which follows.

2. Brief Description of the Invention

The present invention provides for a string tensioning part for a stringed ball racket. A more or less flat extending string tensioning part is formed of a profile section having a periphery with recesses for engaging strings of uniform direction by inserting the string tensioning part between several strings of the same direction. This results in that these strings are lifted up or, respectively, down relative to their original joint plane and relative to each neighboring string of the same direction.

The string tensioning part topologically can resemble an ellipsoidal plate. A periphery back of the string tensioning part can be rounded such that width (h) of the string tensioning part is decreased toward the two ends of the string tensioning part corresponding to main axis ends of the topologically related ellipsoid. The periphery back can be furnished with at least two recesses for receiving center strings relative to the string tensioning part. One of the two ends of an axis, through a maximum diameter of the string tensioning part, can be tipped.

A borehole can be furnished in the string tensioning part for insertion of a tool.

Depending on an arrangement within the strike surface of the ball racket, there can be provided a long structure for contacting and tensioning long strings or a short structure for contacting or tensioning short strings of the string tensioning part.

The cross-section of the string tensioning part, through a plane perpendicular to the longitudinal direction of the profile section, can assume a rectangular shape. The cross-section of the string tensioning part can also assume a shape of a double-T girder.

The string tensioning part can be flattened toward the two ends corresponding to a maximum diameter of the string tensioning part relative to the width level as measured by the cross-section perpendicular to the maximum diameter.

The string tensioning part can be furnished with a recess for receiving of outer strings at each of the two ends of the string tensioning part corresponding to a maximum diameter of the string tensioning part.

A tool for flipping of a string tensioning part is included. A more or less flat extending string tensioning part is formed of a profile section having a periphery with recesses for engaging strings of uniform direction. Said strings are engaged by inserting the string tensioning part between several strings of the same direction such that these strings are lifted up or, respectively, down relative to their original joint plane and relative to each neighboring string of the same direction and comprising a hole. The tool itself comprises a shaft having a pin attached. Said pin is adapted to fit into a borehole of the string tensioning part. Said pin is bent at an angle of from about 30 to 60 degrees relative to the shaft.

In contrast to conventional plastic platelets, employed mainly for protection and care of the strings, the string tensioning part according to the invention is not employed at crossing points of two strings but rather between crossing points of strings and involves strings of one same, preferably parallel, direction, i.e. it interacts only with longitudinal strings or only with cross strings, whatever the case may be, which strings are then pressed apart and are thereby retensioned.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1A:
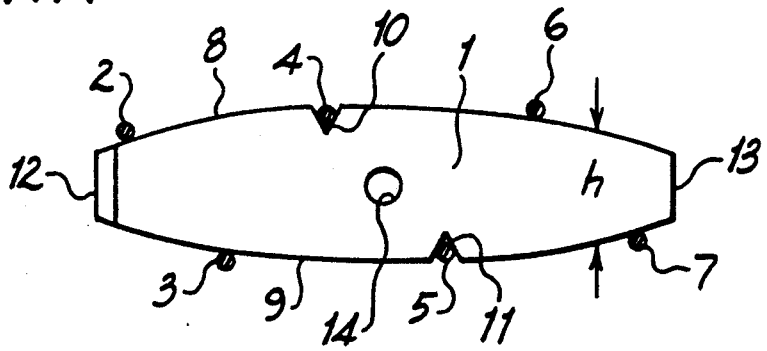
FIG. 1A is a schematic side elevational view of an invention string tensioning part.

In accordance with the present invention, there is provided a string tensioning part for a stringed ball racket. The string tensioning part 1 is formed like a girder. The string tensioning part can be inserted between several strings 2 to 7 of the same direction such that these strings are lifted off from their joint plane and from each other.

A tool for flipping of a string tensioning part can comprise a shaft 24 and a pin 23 adapted to fit into a borehole 14. Said pin 23 can be bent off at an angle of about 45 degrees relative to the shaft 24.

As can be recognized from FIG. 1A, the string tensioning part 1 is rounded on two sides according to a preferred embodiment of the invention. The height h of the string tensioning part decreases in the direction toward the ends 12, 13. The string tensioning part 1 is pointed in a cutter-like manner at one end 12. A borehole 14 is disposed in the center of the string tensioning part, which borehole 14 serves for receiving of a pin 23 of a tool 22, as illustrated for example in FIG. 5.

The string tensioning part 1, inserted into the stringing of a tennis racket, presses apart the longitudinal strings or the cross strings 2–7 and thereby increases the stringing hardness of the racket. The rounded back faces 8 and 9 exhibit, in each case, a groove 10 and 11. The recited grooves 10, 11, serve for receiving of the center strings 4 and 5 with the purpose to fix the string tensioning part or, respectively, to prevent a rotation of the string tensioning part 1.

The rounding of the string tensioning part 1 toward the two ends 12, 13 assures a planar position of the string tensioning part 1 within the stringing. Without this rounding, the string tensioning part 1 would turn or rotate in a counter-clockwise direction, by the force of the end strings 2, 7.

Figure 1B:
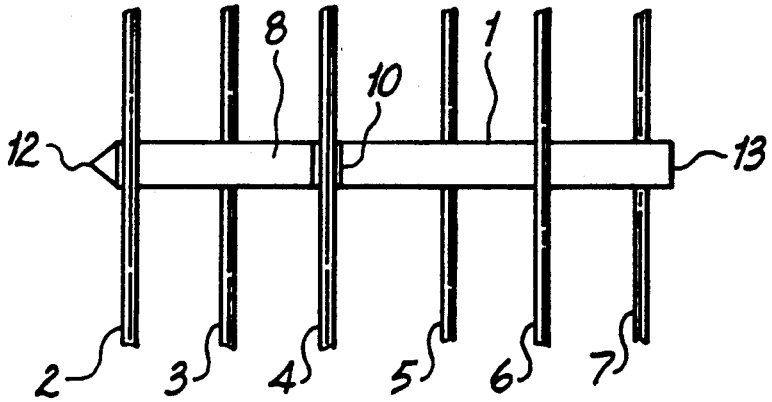
FIG. 1B is a top plan view onto the string tensioning part of FIG. 1.

FIG. 1B illustrates the string tensioning part 1 in a top plan view onto the back face 8 of the string tensioning part. The bezel edge at the end 12 alleviates and eases an insertion of the string tensioning part 1 into the stringing.

Figure 2:
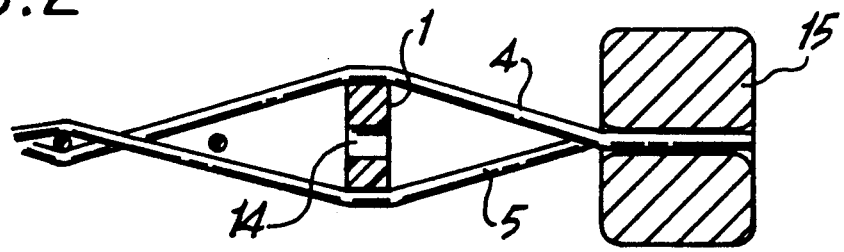
FIG. 2 is a schematic view of a string tensioning part inserted into the stringing of a racket.

FIG. 2 illustrates the string tensioning part 1 as seen from the side. The string tensioning part 1 is inserted into the stringing of a tennis racket in the neighborhood of the frame 15. The center strings 4, 5 are illustrated.

Figure 3:
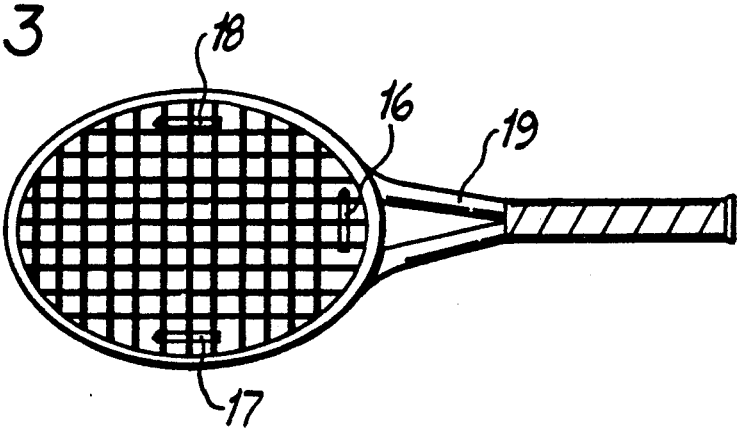
FIG. 3 is a schematic view of an arrangement of three string tensioning parts according to the invention in a tennis racket.

FIG. 3 illustrates a tennis racket having a handle part 19 with three inserted string tensioning parts 16, 17, 18, according to the invention. In this case, the string tensioning part 16 induces an increase in tension on the longitudinal strings, while the string tensioning parts 17, 18 operate on the cross strings. However, in general, an insertion of only one string tensioning part 16 for the longitudinal strings is sufficient since the tension increase, based on a plaiting and interlacing of the racket strings, operates on the entire racket face.

The string tensioning parts, illustrated in the drawing are, in each case, dimensioned for six sequential strings. However, it is also possible to make string tensioning parts for four strings, which are constructed correspondingly. Instead of the string tensioning part 16 furnished for six strings, it is furthermore possible to use two such string tensioning parts for, in each case, four strings, next to each other, whereby a total of eight strings are retensioned.

Finally, it is also possible to employ a short rod-shaped string tensioning part, which is furnished with a nut at each of its two ends, which string tensioning part serves for the pressing apart of only two strings. In this case, any desired number of these string tensioning parts can be disposed next to each other.

The mounting of the string tensioning part 1 is performed such that this string tensioning part 1 is initially inserted in a flat position with the pointed end 12 first between the strings 2–7, whereby the strings are disposed advantageously alternatingly on the two sides of the string tensioning part. Subsequently, the string tensioning part 1 is put in an upright position with the aid of the tool illustrated in FIG. 5, i.e., it is tilted by 90 degrees. This results in the desired increase of the tension. The demounting is performed in reverse fashion.

Materials are to be selected for the string tensioning part 1 which, on the one hand, are sufficiently stable in order to sustain the pressure of the strings and, on the other hand, are sufficiently soft to avoid an injuring of the strings. Furthermore, the material cannot be permitted to have a weight which would be too high.

For example, hard rubber, nylon, or macrolon are examples of materials which can be used for manufacturing the string tensioning part 1. The weight of such a string tensioning part can amount to about 3 grams.

Of course, the string tensioning parts can be produced in different widths and heights in order to effect different levels of string tensioning increases and in order to be usable in case of different rackets having different string distance spacings.

Figure 4B:
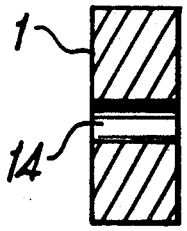
FIG. 4B illustrates a rectangular cross-sectional shape of a string tensioning part.
Figure 4A:
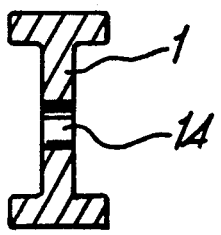
FIG. 4A illustrates a special cross-sectional shape, having a double-T girder-type cross-section, of a string tensioning part.

FIG. 4 illustrates that the cross-section of the string tensioning part 1 can also have the shape of a double-T support rail or girder, thereby saving material costs.

Figure 5:
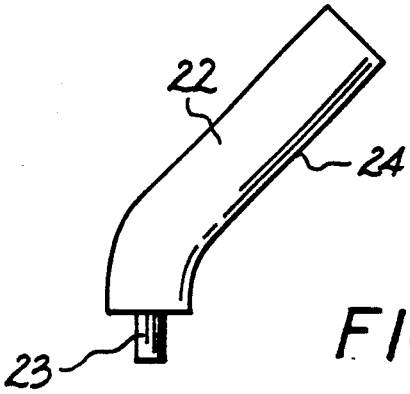
FIG. 5 is a tool for flipping a string tensioning part in and out of the strings of a racket.

FIG. 5 illustrates a tool 22 suitable for putting the string tensioning part 1 into an upright position. The tool 22 is furnished with a shaft 24 and with a pin 23, which pin 23 fits into a borehole 14 of the string tensioning part 1. The pin 23 is bent by about 45 degrees. However, the tool can also have a different shape or form, for example, that of a fork-shaped key.

Figure 6:
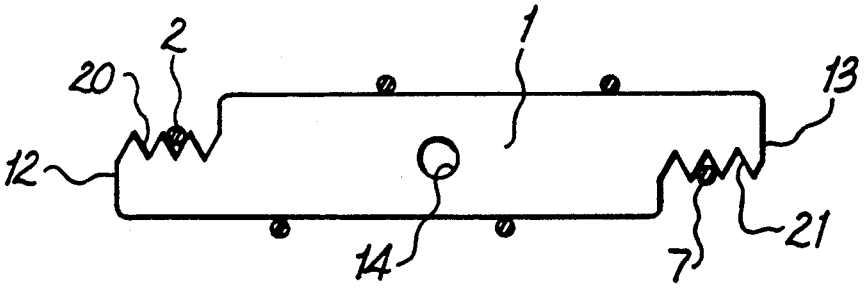
FIG. 6 is a schematic side elevational view of a further string tensioning part according to the invention.

FIG. 6 is an embodiment of the string tensioning part 1, which deviates from the embodiment of FIG. 1. This embodiment of FIG. 6 exhibits substantially a straight beam or girder-shaped contour, however, it is flattened at the two ends 12, 13. This flattening at the two ends 12, 13 serves to avoid a rotation and torsion of the string tensioning part by the strings 2 and 7. Depending on the distance of the strings, the two end strings 2, 7 can be inserted in one of the grooves 20, 21. It is also possible to furnish a plurality of flat, closely neighboring channels instead of the grooves.

Since the string tensioning part 1 can be employed with rackets having different string distance spacings, additional grooves are not provided because they are unnecessary according to the embodiments illustrated in FIGS. 1 and 6.

Instead of the embodiment illustrated in FIG. 6 with flattening at the ends, the string tensioning part 1 can also have a rectangular shape. In this case, it would be advantageous to provide one or several deeper grooves or, respectively, slots or channels for receiving of the end strings 2 and 7.

Figure 7:
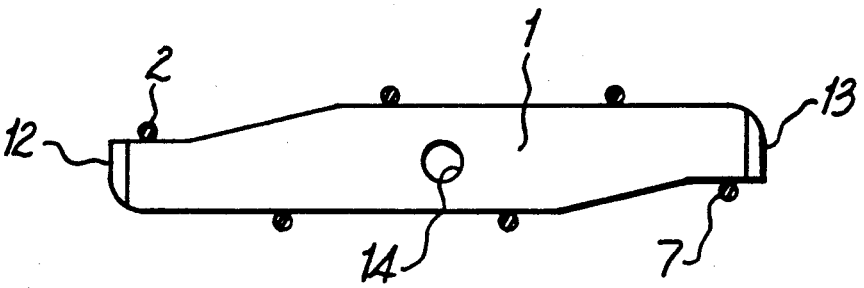
FIG. 7 is a side elevational view of a further embodiment of a string tensioning part according to the invention without notches.

Finally, a string tensioning part 1 is illustrated in FIG. 7, which does not exhibit any notches or grooves. The string tensioning part 1 is flattened at the two ends 12, 13 relative to height and is pointed and can be inserted particularly easily into the stringing based on the flat and smooth edges. The flattening amounts to from about $\frac{1}{3}$ to $\frac{1}{2}$ of the total height.

Based on the use and employment of the string tensioning part according to the invention, there results, by the tensioning increase of mainly the center strings, an increased "sweet spot" of the racket. Thereby, a similar effect is achieved as compared to known stringings with uneven string density, where the distance spacings between the center strings are smaller than the outer strings.

Furthermore, there results a damping of vibrations based on the use of the string tensioning part, both relative to the stringing as well as to the frame, which contributes to the sparing and protection of the arm of the player.

An increase in the torsional moment of the racket, based on the higher edge mass, results from the string tensioning parts 17, 18 inserted on the sides.

The embodiments illustrated in FIGS. 1 to 7 have been found to be particularly advantageous in the course of experiments. However, it will be understood that each of the elements described above, or two or more together, may also find a useful application in other types of tensioning means differing from the types described above.

While the invention has been illustrated. and described as embodied in the context of a string tensioning part for ball rackets, and in particular for tennis and squash rackets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A method for tensioning a stringed ball racket, comprising the steps of at a handle end of said head of said stringed ball racket, inserting an elongated string tensioning member between several substantially parallel disposed strings such that the elongated tensioning member is alternatingly disposed above a longitudinal side of a first one of the several substantially parallel disposed strings and below the longitudinal side of a second one of the several substantially parallel disposed strings, and wherein the elongated string tensioning member includes a middle borehole;

inserting a pin of a tool into the borehole of the elongated string tensioning member; and flipping the elongated string tensioning member with the aid of said tool by an angle of 90° around a center axis of the elongated string tensioning member.

* * * * *